US008845043B2

(12) United States Patent
Bonat

(10) Patent No.: US 8,845,043 B2
(45) Date of Patent: Sep. 30, 2014

(54) ARRANGEMENT FOR A DRAWER PULL-OUT GUIDE

(75) Inventor: Gunter Bonat, Lochau (AT)

(73) Assignee: FULTERER Gesellschaft mbH, Lustenau (AT)

( * ) Notice: Subject to any disclaimer, the term of this patent is extended or adjusted under 35 U.S.C. 154(b) by 0 days.

(21) Appl. No.: 13/701,041

(22) PCT Filed: May 19, 2011

(86) PCT No.: PCT/AT2011/000229

§ 371 (c)(1),
(2), (4) Date: Nov. 30, 2012

(87) PCT Pub. No.: WO2011/150434

PCT Pub. Date: Dec. 8, 2011

(65) Prior Publication Data

US 2013/0069515 A1 Mar. 21, 2013

(30) Foreign Application Priority Data

Jun. 2, 2010 (AT) ..... A 904/2010

(51) Int. Cl.
*A47B 88/00* (2006.01)
*A47B 88/14* (2006.01)
*A47B 88/12* (2006.01)

(52) U.S. Cl.
CPC ..... *A47B 88/14* (2013.01); *A47B 88/12* (2013.01); *A47B 2210/0059* (2013.01); *A47B 2210/0043* (2013.01)
USPC ..... 312/334.13

(58) Field of Classification Search
USPC ..... 312/223.15–334.19, 334.21, 334.25, 312/334.26, 334.44, 334.41–334.43, 334.9, 312/334.11–334.13, 334.36–334.39, 334.7, 312/334.8, 334.33, 334.15–334.19; 384/18, 384/19
See application file for complete search history.

(56) References Cited

U.S. PATENT DOCUMENTS 2,505,592 A * 4/1950 Stone ..... 384/59
2,692,802 A * 10/1954 Bienias et al. ..... 384/19

(Continued)

FOREIGN PATENT DOCUMENTS

AT 002401 10/1998
DE 3818225 12/1989

(Continued)

OTHER PUBLICATIONS

Blum Drawer Pull-Out Guide, 7 photos. Jan. 1, 2004.

*Primary Examiner* — Janet M Wilkens
(74) *Attorney, Agent, or Firm* — Volpe and Koenig, P.C.

(57) ABSTRACT

An arrangement for a drawer pull-out guide (1) that has at least two rails (5, 6, 7) that are guided on one another in a telescopic manner is provided. The arrangement has at least one roller (2), at least one roller axis (3), and at least one roller support body (4). The roller (2) is rotatably mounted on the roller axis (3), and the roller axis (3) is arranged on the roller support body (4), in particular in a fixed manner. The roller support body (4) is a separate component from all the rails (5, 6, 7) of the drawer pull-out guide (1), and the roller support body (4) has at least one first connecting device (8) for fixing the roller support body (4) on the rails or on one of the rails (5, 6, 7) of the drawer pull-out guide (1).

19 Claims, 6 Drawing Sheets

(56) References Cited

U.S. PATENT DOCUMENTS

| | | | | | |
|---|---|---|---|---|---|
| 4,162,114 | A | * | 7/1979 | Litchfield et al. | 312/334.1 |
| 4,227,750 | A | * | 10/1980 | Rock et al. | 384/18 |
| 4,304,449 | A | * | 12/1981 | Litchfield et al. | 312/334.18 |
| 4,737,039 | A | | 4/1988 | Sekerich | |
| 5,484,199 | A | * | 1/1996 | Gasser et al. | 312/334.33 |
| 6,015,199 | A | | 1/2000 | Netzer et al. | |
| 6,325,473 | B1 | | 12/2001 | Brustle et al. | |
| 7,597,413 | B2 | * | 10/2009 | Fitz | 312/334.15 |
| 7,770,329 | B2 | * | 8/2010 | Hutnik et al. | 49/425 |
| 7,866,772 | B1 | * | 1/2011 | Chen | 312/334.9 |
| 8,348,361 | B2 | * | 1/2013 | Joerger et al. | 312/334.18 |
| 2004/0212284 | A1 | * | 10/2004 | Fitz | 312/334.13 |
| 2008/0224583 | A1 | | 9/2008 | Prenter | |
| 2010/0320889 | A1 | * | 12/2010 | Prentner | 312/334.18 |
| 2012/0049712 | A1 | * | 3/2012 | Lobbezoo | 312/334.12 |

FOREIGN PATENT DOCUMENTS

| | | | |
|---|---|---|---|
| DE | 29817746 | | 2/1999 |
| DE | 102005028673 | | 12/2006 |
| EP | 613640 | * | 9/1994 |
| EP | 0664983 | | 12/1994 |
| EP | 0868866 | | 10/1998 |
| EP | 1470771 | | 10/2004 |
| EP | 2168457 | | 11/2012 |
| GB | 2093334 | * | 9/1982 |
| WO | 2007010500 | | 1/2007 |
| WO | 2011150435 | | 12/2011 |

* cited by examiner

ARRANGEMENT FOR A DRAWER PULL-OUT GUIDE

INCORPORATION BY REFERENCE

The following documents are incorporated herein by reference as if fully set forth: International Application No. PCT/AT2011/000229, filed May 19, 2011; Austrian Patent Application No.: A904/2010, filed Jun. 2, 2010

BACKGROUND

The present invention relates to an arrangement for a drawer pull-out guide having at least two rails guided telescopically one on the other, the arrangement having at least one roller and at least one roller axis and also at least one roller carrier body, and the roller being mounted rotatably on the roller axis and the roller axis being arranged, in particular fixedly, on the roller carrier body.

Drawer pull-out guides are known in the prior art in a multiplicity of embodiments. These are usually systems in which at least two rails are moved in and out telescopically one in the other or one on the other, so that a drawer can be pulled out of a furniture body and can be pushed into this again. In the prior art, a distinction is made in drawer pull-out guides between what are known as simple pull-outs and what are known as full pull-outs. In simple pull-outs, as a rule, there are in each case two rails telescopically mounted one on the other. The rail to be fastened to the furniture body is often also designated as a body rail. The rail fastened or to be fastened to the drawer itself is designated inter alia as a drawer rail. In the case of a simple pull-out, part of the drawer remains in the furniture body even in the position pulled out to the maximum. This is not the case in what are known as full pull-outs. If a drawer is fastened in a furniture body by means of a full pull-out, the drawer can be pulled completely out of this furniture body. For this purpose, the full pull-out requires, as a rule, in each case three rails mounted telescopically one on the other. The rail to be fastened to the furniture body is in this case once again designated as a body rail and the rail fastened or to be fastened to the drawer is again designated as a drawer rail. The third rail makes the connection between the drawer rail and body rail and is usually designated as a middle rail. In order to mount these rails displaceably one in the other and one on the other, various systems are likewise known in the prior art.

The invention described below is concerned particularly with systems in which the rails of the drawer pull-out guide are mounted displaceably one in the other or one on the other by means of rollers.

In the simple pull-outs known in the prior art, a roller is required at the front end of a drawer rail, as seen in the push-in direction. By contrast, in full pull-outs according to the prior art, it is neither necessary nor possible to provide a roller at the front end of the drawer rail, as seen in the push-in direction of the drawer. In the prior art, therefore, generic arrangements are drawer rails of simple pull-outs, on which the roller axis on which the roller is mounted rotatably is arranged directly. In these generic arrangements, the roller carrier body is therefore the drawer rail.

For the companies involved in furniture construction, then, the problem arises that they have to keep in stock or use different drawer rails for full pull-outs from those for simple pull-outs, thus signifying overall increased outlay in terms of logistics and storage.

SUMMARY

The object of the present invention is, therefore, to provide a generic arrangement for a drawer pull-out guide, in which this problem is avoided.

This is achieved, according to the invention, in that in generic arrangements there is provisions whereby the roller carrier body is a component separate from all the rails of the drawer pull-out guide, and the roller carrier body has at least one first connecting device for fastening the roller carrier body to the rail or one of the rails of the drawer pull-out guide.

An essential basic idea of the invention is thus that the roller carrier body used is no longer a rail, but instead a component separate or initially separate from this and this roller carrier body is equipped with at least one first connecting device, by means of which the roller carrier body can be fastened subsequently to the rail or one of the rails of the drawer pull-out guide. It thereby becomes possible to use the same drawer rail both for a simple pull-out and for a full pull-out. If the drawer rail is required for a simple pull-out, the roller carrier body is connected to the drawer rail by means of the connecting device. If the drawer rail is required for a full pull-out, however, it can readily be used without the roller carrier body and consequently also without the roller. For the sake of completeness, however, it is pointed out that arrangements according to the invention can, of course, not only be employed in conjunction with drawer rails. The basic idea of keeping in reserve a roller carrier body, together with a roller mounted rotatably on it, as a separate component may, of course, be adopted for the purpose of equipping the most diverse possible rails of drawer pull-out guides, as required, with a corresponding roller.

With a view to simple mounting of the roller carrier body on a rail, there may be provision, in particular, whereby the roller carrier body can be plugged onto the rail, preferably can be plugged into a reception channel of the rail. The connecting device can permit non-positive and/or positive fastening of the roller carrier body to the rail or one of the rails. Especially preferred embodiments provide for the connecting device to be part of a snap connection for fastening the roller carrier body to the rail or one of the rails.

It is basically possible, then, for the roller carrier body to be fastened to the respective rail, as required, by hand or mechanically, before this rail is inserted into the other rail of the drawer pull-out guide. Especially preferred embodiments of the invention, however, provide for the roller carrier body to have at least one second connecting device for the preferably releasable fastening of the roller carrier body to a second rail of the drawer pull-out guide. It thereby becomes possible to pre-mount the roller carrier body in the second rail of the drawer pull-out guide, such as, for example, a body rail of a simple pull-out, so that the fastening of the first rail or of the drawer rail to the roller carrier body takes place automatically when said rail is pushed for the first time into the second rail or into the body rail.

In this respect, the invention also relates to a rail, in particular body rail, of a drawer pull-out guide, in particular of a simple pull-out, an arrangement according to the invention being pre-mounted by means of one of the connecting devices, preferably by means of the second connecting device, nondestructively on another component of the rail, preferably on another roller fastened rotatably to the rail.

The invention basically also relates, further, to a drawer pull-out guide having an arrangement according to the invention.

However, the invention also relates, further, to a set which has at least the following constituents:

at least one body rail of a simple pull-out, and at least one preferably pre-mounted arrangement comprised of a body rail and of a middle rail of a full pull-out, and at least one drawer rail arranged preferably fixedly on a drawer, the drawer rail being capable of being installed both in the body rail of the simple pull-out and in the middle rail of the full pull-out.

BRIEF DESCRIPTION OF THE DRAWINGS

Further features and details of preferred embodiments of the present invention may be gathered from the following figure description. In the figures.

DETAILED DESCRIPTION OF THE PREFERRED EMBODIMENTS

Figure 2:
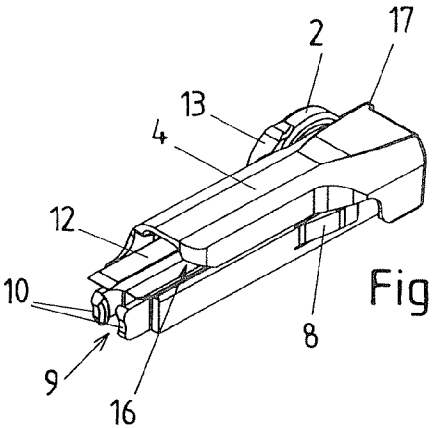
FIGS. 1 to 6 show various views of an arrangement designed according to the invention.
Figure 3:
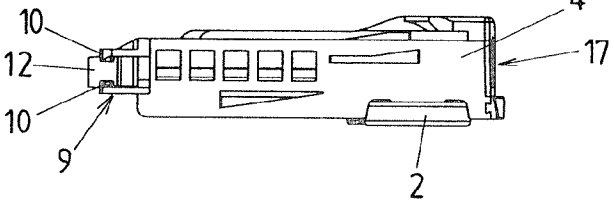
Figure 4:
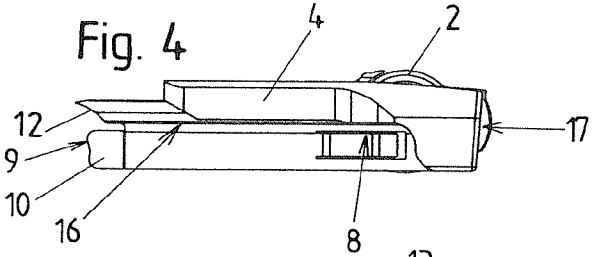
Figure 5:
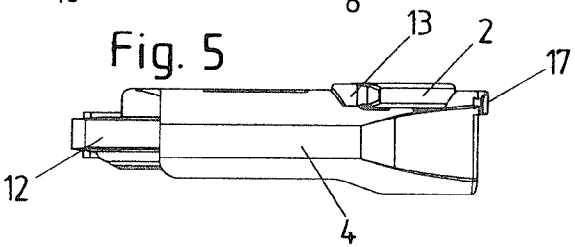
Figure 1:
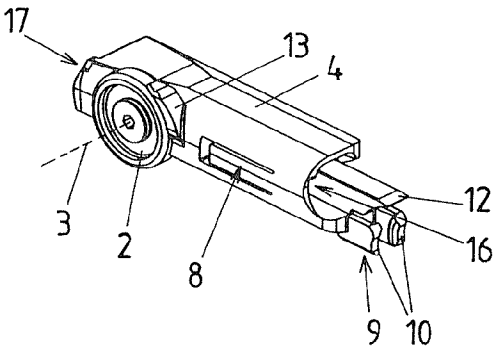

FIGS. 1 and 2 show perspective illustrations of an arrangement designed according to the invention for a drawer pull-out guide 1 having at least two rails 5, 6, 7 guided telescopically one on the other, the arrangement having at least one roller 2 and at least one roller axis 3 and also at least one roller carrier body 4, and the roller being mounted rotatably on the roller axis 3 and the roller axis 3 being arranged, in particular fixedly, on the roller carrier body 4. The roller carrier body 4 is in this case a part separate from all the rails 5, 6, 7 of the drawer pull-out guide, that is to say is not part of one of the rails 5, 6, 7 of the drawer pull-out guide 1. It is correspondingly also illustrated in FIGS. 1 to 6 as an individual part detached from any rails 5, 6, 7. The roller carrier body 4 has a first connecting device 8 for fastening the roller carrier body 4 to the rail or one of the rails 5, 6, 7 of the drawer pull-out guide 1. In the exemplary embodiment according to FIGS. 1 to 6, the first connecting device 8 serves for fastening the roller carrier body 4 to the drawer rail 7. In the exemplary embodiment shown, the drawer rail 7 can be pushed into the reception channel 16 of the roller carrier body 4. The first connecting device 8 is part of a snap connection. FIGS. 3 to 6 show four side views in each case from different directions. In the exemplary embodiment shown, the roller carrier body 4 additionally has at least one second connecting device 9 for the preferably releasable fastening of the roller carrier body 4 to a second rail 5 of the drawer pull-out guide 1. The connecting devices 8, 9 can basically permit non-positive and/or positive fastening of the roller carrier body 4 to the rail or one of the rails 5, 6, 7. It should be noted, however, that there is preferably provision for the connecting devices 8 and/or 9 to permit a snap connection for fastening the roller carrier body 4 to the rail or one of the rails 5, 6, 7. It is beneficial if the first connecting device 8 and the second connecting device 9 fasten the roller carrier body 4 to the respective rail 5, 6, 7 with differing firmness. In the exemplary embodiment actually shown, the first connecting device 8 is designed to be stronger than the second connecting device 9. The result of this is that, after the rail 7 has been introduced into the reception channel 16 of the roller carrier body 4 and the first connecting device 8 has been snapped in, the carrier body 4 is fastened to the rail 7 with firmness such that the fastening to the other rail 5 by means of the second connecting device 9 is released as a result of continued pressing upon the rail 7.

The second connecting device 9 of the exemplary embodiment shown has two spring hooks 10, arranged opposite one another, for engagement into another roller 11 arranged on one of the rails 5, 6, 7. Alternatively, it is also conceivable to equip corresponding second connecting devices 9 with only one or with more than two spring hooks 10. In the exemplary embodiment shown, the roller carrier 4 has in the region of the second connecting device 9 a projection 12 which is here of wedge-shaped design. This can serve for protecting a roller 11 and/or as a guide onto another roller 11 arranged on the rail or one of the rails 5, 6, 7. With a view to cost-effective production in large quantities, preferred embodiments, such as that shown here, provide for the roller carrier 4 to be a plastic part preferably manufactured by the injection molding method. This may in this case be a single-component injection molding, but also what is known as a multi-component injection molding in which the plastic part has at least two different plastics. The plastic part may, of course, also be manufactured, in regions, from materials other than plastic. However, in especially simple embodiments, there is a pure plastic part, that is to say without other materials being used.

In the exemplary embodiment illustrated, the roller carrier body 4 has a limit stop 17 which, in a preferred embodiment, is comprised of a softer material than the remaining roller carrier body 4. Such roller carrier bodies 4 with a limit stop can also be produced simply and cost-effectively by multi-component injection molding.

Figure 6:
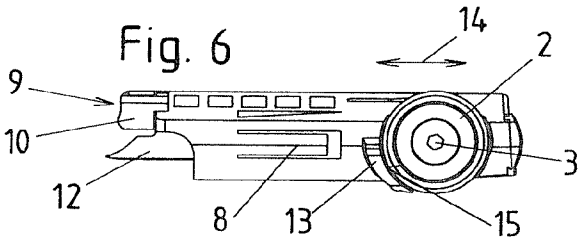

As can be seen clearly especially FIGS. 1, 2 and 6, the roller carrier body 4 illustrated also has an impact damping body 13 which, as seen in a direction 14 perpendicular to the roller axis 3, is arranged, at least in regions, preferably directly in front of and/or behind the roller 2 mounted rotatably on the roller axis 3 and which has a material softer than that of the roller 2 mounted rotatably on the roller axis 3. What is achieved thereby is that the arrangement does not impact directly with the roller 2, but just with the softer impact damping body 13, preferably when one of the end positions is reached. This, on the one hand, avoids disturbing impact noises. On the other hand, the roller 2 is thereby protected and safe against damage which disrupts smooth running.

Beneficially, as is also implemented in the exemplary embodiment shown here, there is provision for both the roller carrier axis 3 and the impact damping body 13 to be arranged on the roller carrier body 4. In particular, the impact damping body 13 may in this case be formed in one piece onto the roller carrier body 4. The impact damping body 13 is beneficially comprised of a plastic or includes a plastic. In the exemplary embodiment shown, the impact damping body 13 has a contact face 15 for touching the roller 2. In a non-loaded state of the impact damping body 13, as is illustrated in FIGS. 1 to 6, the contact face 15 is lifted off from the roller 2. In a loaded state in which a corresponding counterstop of, for example, a rail impinges onto the impact damping body 13, there may be provision for the contact face 15 then to come to bear against the roller 2. As is also implemented in the exemplary embodiment shown, there is preferably provision for the contact face 15 to be, at least in regions, of curved, preferably essentially circular design. In the variant illustrated, the entire impact damping body 13 is designed, in regions, to be curved essentially in the form of a circular ring. The impact damping body 13 is designed here as a freely projecting arm. In the variant illustrated, this arm is embodied such that it is correspondingly curved. So as not to take up construction space unnecessarily, preferred embodiments, such as that shown here, provide for the impact damping body to extend over less than half, preferably over less than one quarter, of the circumference of the roller 2.

Figure 7:
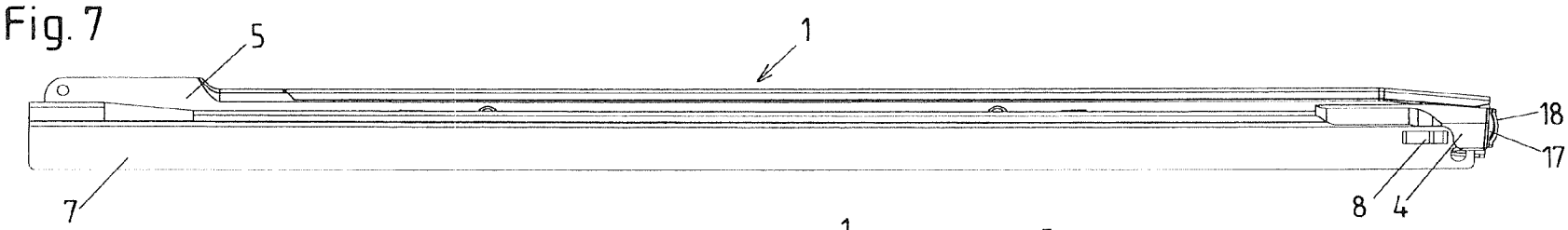
FIGS. 7 to 9 show various illustrations of a simple pull-out having the arrangement according to FIGS. 1 to 6.
Figure 8:
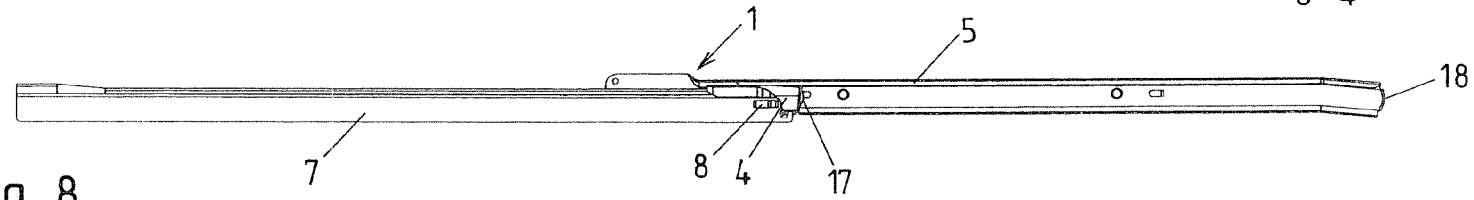
Figure 9:
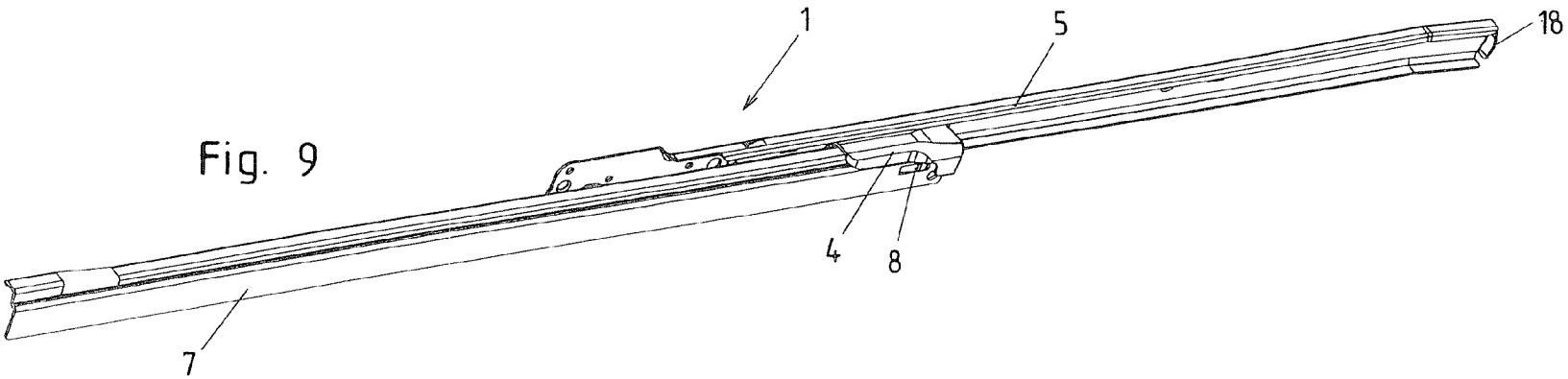
Figure 10:
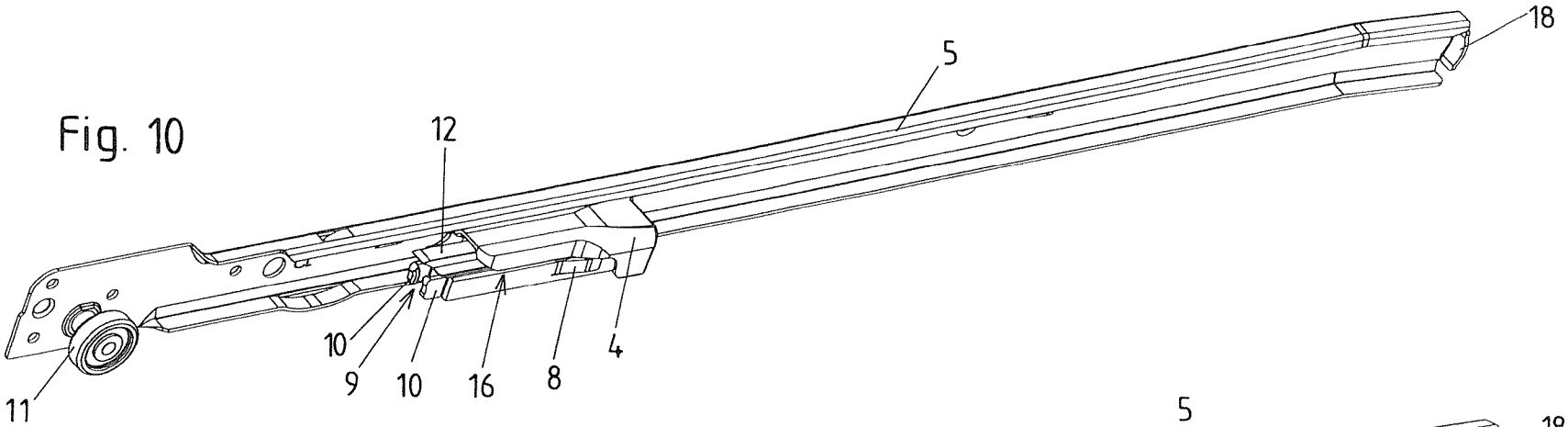
FIGS. 10 and 11 show the simple pull-out from FIGS. 7 to 9, but without a drawer rail.
Figure 11:
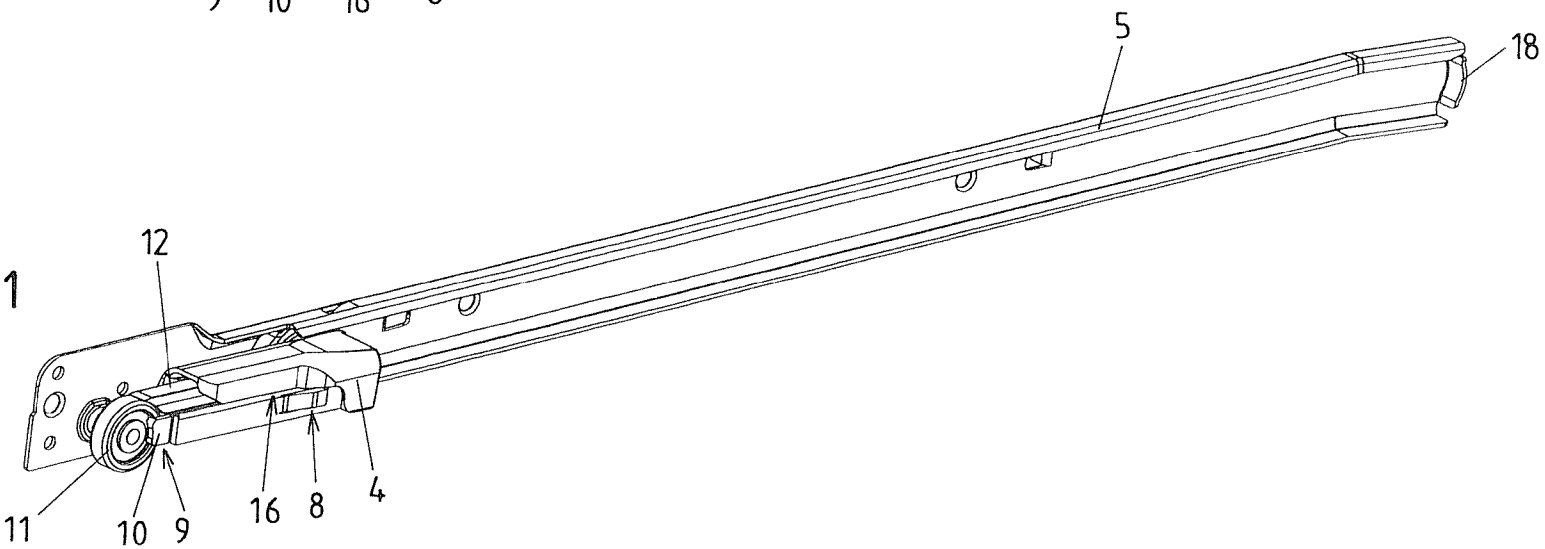

FIGS. 7 to 9 show various views of a drawer pull-out guide 1 designed as a simple pull-out. For the sake of completeness, it is pointed out that these and also the following Figures only ever show one side of the drawer pull-out guide 1. As is known per se, a correspondingly mirror-symmetrically designed second drawer pull-out guide 1 is to be provided in each case on the other side of the drawer. In FIG. 7, the two rails 5 and 7, that is to say the body rail 5 and drawer rail 7, which are mounted telescopically one on the other, are pushed completely one into the other. This corresponds to the position in which the drawer is in the closed position, that is to say pushed completely into the furniture body. In this end position, the limit stop 17 arranged on the roller carrier body 4 butts against the limit counterstop 18 of the body rail 5. FIG. 8 shows an intermediate position near the fully telescopically retracted position of the two rails 5 and 7, which corresponds to the maximum opening state of the drawer. FIG. 9 shows in perspective an intermediate position. In all three FIGS. 7-9, the drawer rail 7 is pushed completely into the reception channel 16. The first connecting device 8 in this case ensures that the roller carrier body 4 is fastened securely to the drawer rail 7. This corresponds to the normal operating state in which the roller 2 required for the simple pull-out at the front end of the drawer rails in the push-in direction is fastened to this by means of the roller carrier body 4. In FIGS. 10 and 11, for clearer illustration, in each case the drawer rail 7 is omitted. FIG. 10 shows the intermediate position according to FIG. 9. FIG. 11 shows the situation in which the arrangement according to the invention of the roller carrier body 4, roller axis 3 and roller 2 is pre-mounted on the body rail 5. The body rail 5 can be delivered by the manufacturer in this state and be mounted in the furniture body. In the pre-mounted position according to FIG. 11, one of the connecting devices 8, 9, here the second connecting device 9, is releasably fastened non-destructively to another component of the body rail 5. In the exemplary embodiment shown, the other component is another roller 11 fastened rotatably to the body rail 7. In actual fact, in the exemplary embodiment illustrated, the spring hooks 10 of the second connecting device 9 engage on the other roller 11 or into this.

In this position, then, the drawer rail 7 can be pushed into the reception channel 16 of the roller carrier body 4. During push-in, the wedge-shaped projection 12 ensures a corresponding guidance of the drawer rail 7 and in this case at the same time protects the roller 11. In the exemplary embodiment shown, when the drawer rail 7 is pushed a corresponding distance into the reception channel 16, the fastening of the drawer rail 7 to the roller carrier body 4 by means of the first connecting device 8 takes place by latching. When this has occurred and when the drawer rail 7 is then pushed further on towards the limit stop 18, that is to say in the push-in direction, the second connecting device 9 is automatically released from the other roller 11, so that the drawer rail 7 and roller carrier body 4 can henceforth be moved jointly along the body rail 5.

Figure 12:
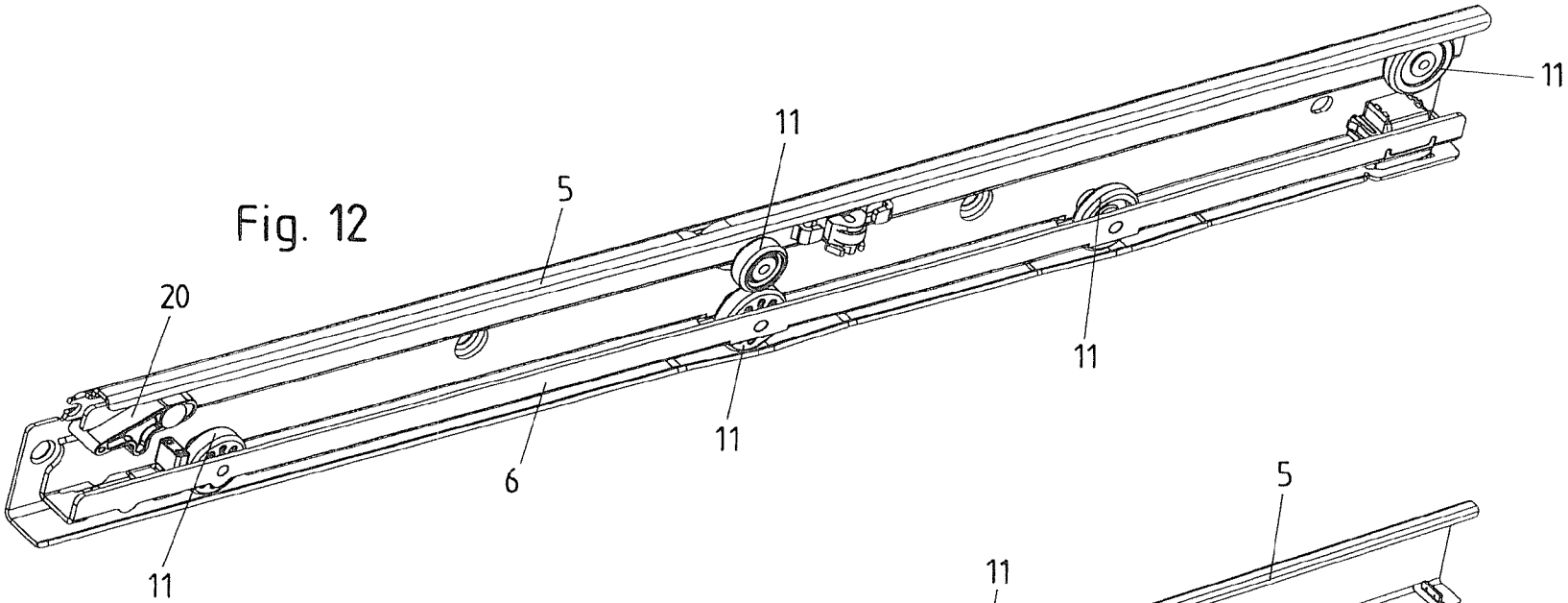
FIGS. 12 to 14 show various views of a full pull-out.
Figure 13:
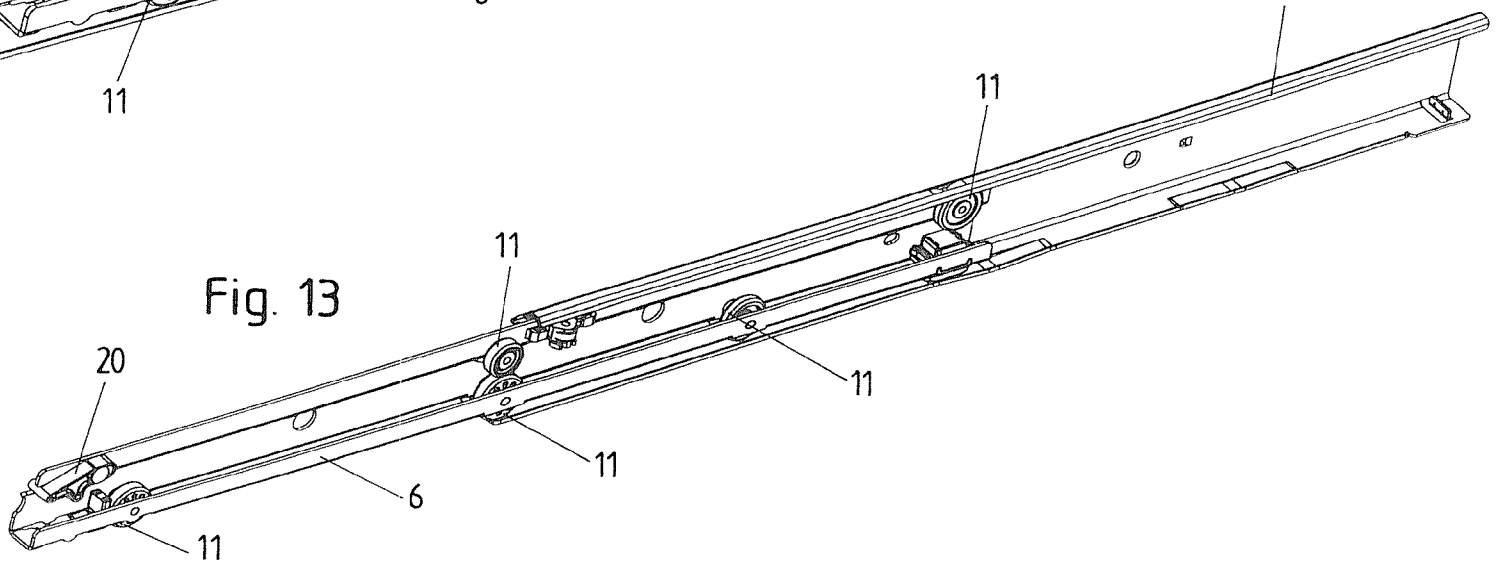
Figure 14:
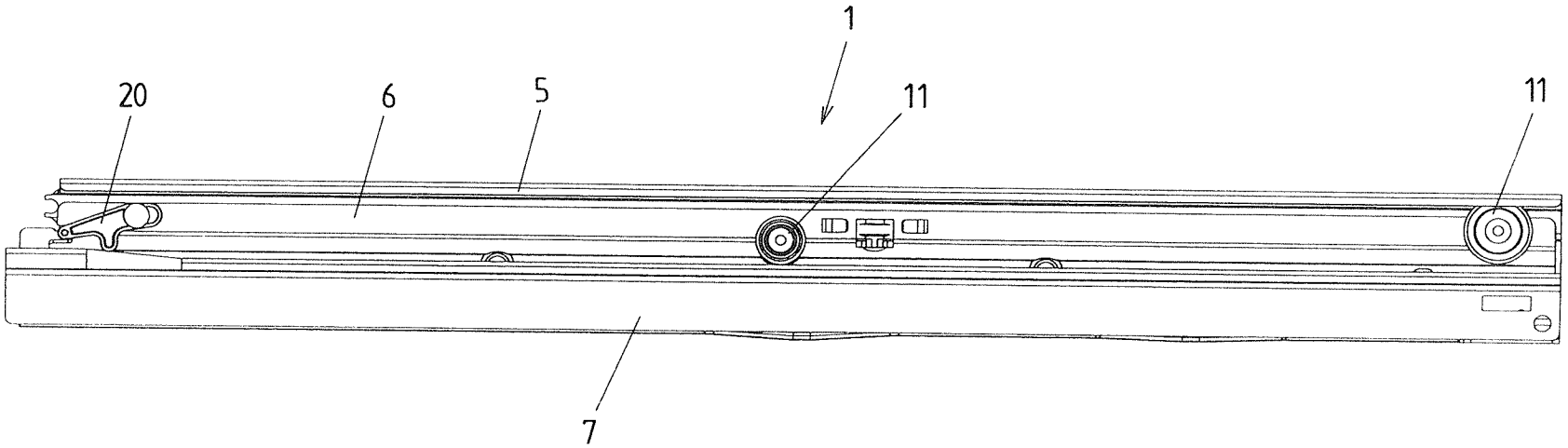

FIGS. 12 to 14 show, then, a drawer pull-out guide 1 designed as a full pull-out known per se, only the body rail 5 and middle rail 6 being illustrated in FIGS. 12 and 13. FIG. 12 shows the position in which the middle rail 6 is moved completely into the body rail 5. FIG. 13 shows a position in which the middle rail 6 is pulled out of the body rail 5. The anti-lift device 20 known per se prevents the drawer rail from being able to be pulled out of the middle rail 6 undesirably. All this is known per se and does not have to be explained any further.

FIG. 14 shows the entire drawer pull-out guide 1 designed as a full pull-out. What should be noted in this respect is essentially that the same drawer rail 7 can be used for this full pull-out according to FIGS. 12 to 14 as for the simple pull-out shown in FIGS. 7 to 11. For use in a full pull-out, a roller carrier body 4 is not arranged on the drawer rail 7. If the same drawer rail 7 is to be used for the simple pull-out according to FIGS. 7 to 11, the roller 2 required for this purpose at the front end of the drawer rail 7 in the push-in direction is fastened to the drawer rail 7 by the roller carrier body 4 being placed onto the latter.

Figure 15:
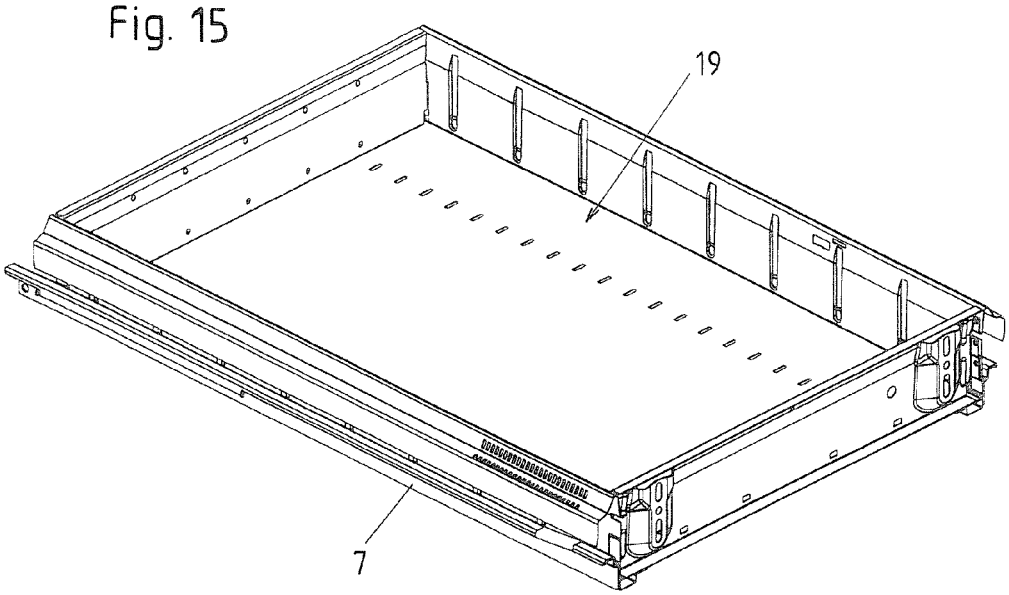
FIGS. 15 and 16 show a drawer with an integrated drawer rail.
Figure 16:
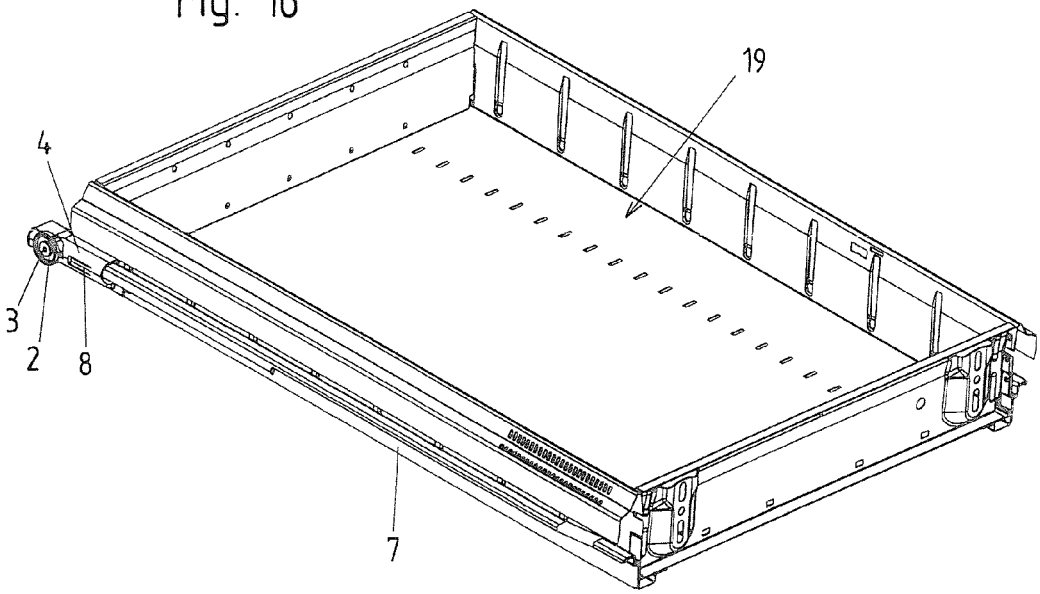

FIGS. 15 and 16 show another preferred embodiment of a drawer 19. In this, the drawer rail 7 is arranged fixedly on the body of the drawer 19. This may take place, for example, by the drawer rail 7 being welded to corresponding side faces of the drawer 19. In FIG. 15, the roller carrier body 4, together with the roller axis 3 and roller 2, is absent at the front end of the drawer rail 7 in the push-in direction. The drawer 19 can be used in this form together with the full pull-out according to FIGS. 12 to 14. In FIG. 16, the roller carrier body 4, roller axis 3 and roller 2 are fastened to the drawer rail 7 by means of the first connecting device 8. In this embodiment, the same drawer, together with the body rail 5 according to FIGS. 7 to 11, can be used as a simple pull-out.

The drawer rail 7, of course, does not necessarily have to be fastened fixedly to the drawer 19. It may also be the case that the drawer rail 7 is manufactured as a separate part and is screwed or otherwise fastened to corresponding regions, in particular side walls, of the drawer. Both with the simple pull-out and with the full pull-out, there is in any case beneficially provision for the drawer rail 7 or the drawer 19 to be demountable, beyond a corresponding stop, out of the respective drawer pull-out guide 1.

LEGEND FOR THE REFERENCE NUMERALS

1 Drawer pull-out guide
2 Roller
3 Roller axis
4 Roller carrier body
5 Rail
6 Rail
7 Rail
8 First connecting device
9 Second connecting device
10 Spring hook
11 Other roller
12 Wedge-shaped projection
13 Impact damping body
14 Direction
15 Contact face
16 Reception channel
17 Limit stop
18 Limit counterstop
19 Drawer
20 Anti-lift device

The invention claimed is:

1. An arrangement for a drawer pull-out guide having at least two rails guided telescopically one on the other, the arrangement comprising at least one roller and at least one roller axis and also at least one roller carrier body, the roller is mounted rotatably on the roller axis and the roller axis is arranged on the roller carrier body, the roller carrier body is a separate component, and the roller carrier body has at least one first connecting device for fastening the roller carrier body to at least one of the rails of the drawer pull-out guide, and the roller carrier body has arranged thereon an impact damping body which, as seen in a direction perpendicular to the roller axis, is arranged, at least in regions, at least one of in front of or behind the roller mounted rotatable on the roller axis and which has a material softer than that of the roller mounted rotatably on the roller axis.

2. The arrangement as claimed in claim 1, wherein the roller carrier body has at least one second connecting device for fastening of the roller carrier body to a second one of the rails of the drawer pull-out guide.

3. The arrangement as claimed in claim 2, wherein the first connecting device and the second connecting device are capable of fastening the roller carrier body to the respective rail with differing firmness.

4. The arrangement as claimed in claim 2, wherein the second connecting device has at least one spring hook for engagement into another roller arranged on one of the rails.

5. The arrangement as claimed in claim 2, wherein the roller carrier body has a projection for at least one of protecting another roller or acting as a guide onto another roller arranged on at least one of the rails.

6. The arrangement as claimed in claim 5, wherein the projection is at least one of being wedge shaped or located in a region of the second connecting device.

7. A rail of a drawer pull-out guide comprising an arrangement as claimed in claim 2, which is pre-mounted by one of the connecting devices releasably nondestructively releasably on another component of the rail.

8. The rail as claimed in claim 7, wherein the rail is mounted via the second connecting device.

9. The arrangement as claimed in claim 2, wherein the at least one second connection device is capable of fastening the roller carrier body releasably to the second one of the rails of the drawer pull-out guide.

10. The arrangement as claimed in claim 2, wherein the second connecting device has two spring hooks, arranged opposite one another, for engagement into another roller arranged on one of the rails.

11. The arrangement as claimed in claim 1, wherein the connecting device permits at least one of non-positive or positive fastening of the roller carrier body to at least one of the rails.

12. The arrangement as claimed in claim 1, wherein the roller carrier body is a plastic part comprising a plastic or at least two different plastics.

13. The arrangement as claimed in claim 12, wherein the roller carrier body is an injection molded part.

14. The arrangement as claimed in claim 1, wherein the roller axis is arranged fixedly on the roller carrier body.

15. The arrangement as claimed in claim 1, wherein the connecting device has a snap connection for fastening the roller carrier body to the rail or one of the rails.

16. A set, comprising:

a body rain of a simple pull-out, a drawer rail, an arrangement comprising at least one roller and at least one roller axis and also at least one roller carrier body, the roller is mounted rotatably on the roller axis and the roller axis is arranged on the roller carrier body, the roller carrier body is a component separate from the body rail of the simple pull-out and the drawer rail, and the roller carrier body has at least one first connecting device for fastening the roller carrier body to the drawer rail and at least one second connecting device for fastening the roller carrier body to the body rail of the simple pull-out, the arrangement is pre-mounted by the second connecting device nondestructively releasably on another component of the body rail of the simple pull-out, and at least one array comprised of a body rail of a full pull-out and a middle rail of a full pull-out, the drawer rail being capable of being installed both in the body rail of the simple pull-out and in the middle rail of the full pull-out.

17. The set as claimed in claim 16, wherein the drawer rail is arranged fixedly on a drawer.

18. The set as claimed in claim 16, wherein the another component of the body rail of the simple pull-out is another roller fastened rotatably to the body rail of the simple pull-out.

19. A drawer pull-out guide comprising a rail and a second rail and an arrangement including at least one roller and at least one roller axis and also at least one roller carrier body, the roller is mounted rotatably on the roller axis and the roller axis is arranged on the roller carrier body, the roller carrier body is a component separate from the rail and the second rail of the drawer pull-out guide, and the roller carrier body has at least one first connecting device for fastening the roller carrier body to the rail of the drawer pull-out guide and at least one second connecting device for fastening the roller carrier body to the second rail of the drawer pull-out guide, the arrangement is pre-mounted by the second connecting device nondestructively releasably on another component of the second rail, and the another component of the second rail is another roller fastened rotatably to the second rail.

* * * * *